US007021460B2

(12) United States Patent
Roeback et al.

(10) Patent No.: US 7,021,460 B2
(45) Date of Patent: Apr. 4, 2006

(54) ADJUSTABLE HANGING SPORTS EQUIPMENT HOLDER AND DISPENSER

(75) Inventors: Gerald Oliver Roeback, Stone Mountain, GA (US); Elizabeth Sabrina Roeback, Stone Mountain, GA (US)

(73) Assignee: Gerald O. Roeback, Stone Mountain, GA (US)

( * ) Notice: Subject to any disclaimer, the term of this patent is extended or adjusted under 35 U.S.C. 154(b) by 67 days.

(21) Appl. No.: 10/736,317

(22) Filed: Dec. 16, 2003

(65) Prior Publication Data

US 2005/0126939 A1 Jun. 16, 2005

(51) Int. Cl.
*B65D 85/00* (2006.01)

(52) U.S. Cl. ..... 206/315.9; 221/309; 383/117

(58) Field of Classification Search ..... 206/315.9; 224/919; 383/38–40, 117; 220/489, 493; 473/424, 430, 575–576; 221/309
See application file for complete search history.

(56) References Cited

U.S. PATENT DOCUMENTS

| | | | | | |
|---|---|---|---|---|---|
| 1,737,065 | A | * | 11/1929 | Thornton | 383/117 |
| 1,778,225 | A | * | 10/1930 | Morss | 206/315.9 |
| 1,872,640 | A | * | 8/1932 | Berry | 206/315.9 |
| 2,573,770 | A | * | 11/1951 | Meadow | 220/489 |
| 3,225,806 | A | * | 12/1965 | Pollak et al. | 206/315.9 |
| 5,150,970 | A | * | 9/1992 | Albarelli | 383/117 |
| 5,186,374 | A | * | 2/1993 | Buxton | 206/315.9 |
| 5,386,906 | A | * | 2/1995 | Lai | 206/315.9 |
| 5,909,833 | A | * | 6/1999 | Smith | 224/919 |
| 6,021,896 | A | * | 2/2000 | Marshall | 206/315.9 |
| 6,257,406 | B1 | * | 7/2001 | Garino | 206/315.9 |

* cited by examiner

*Primary Examiner*—Bryon P. Gehman
(74) *Attorney, Agent, or Firm*—Gerald O. Roeback; Elizabeth S. Roeback

(57) ABSTRACT

An adjustable holder for sports equipment is disclosed. The holder is comprised of tubular material with elasticized openings at the top and bottom of the tubular material, at least one opening in the tubular material, a hanging structure attached to the top and an internal structure for adjusting the length of the tubular material. The holder is further comprised of at least one sports ball.

7 Claims, 1 Drawing Sheet

FIG. 1
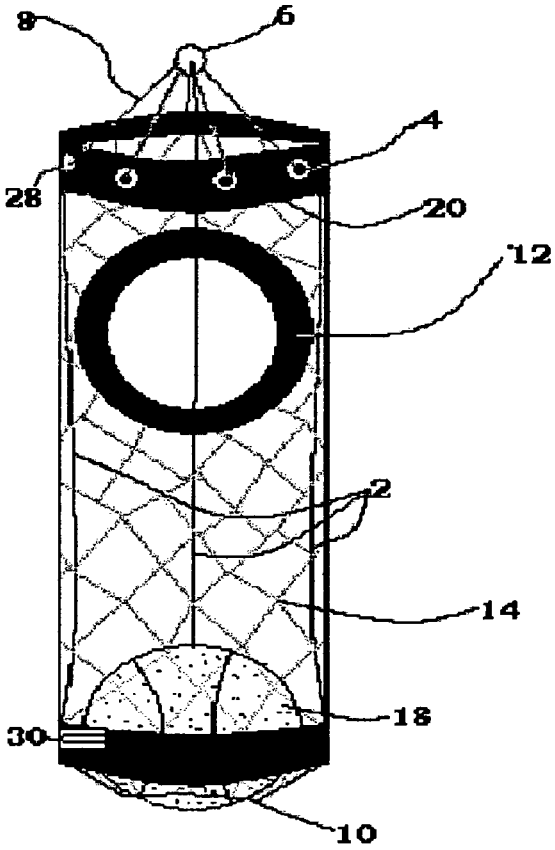
FIG. 2
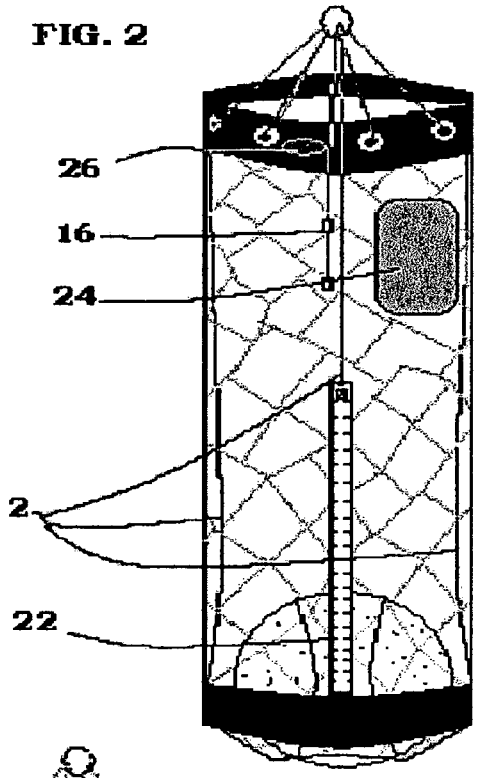
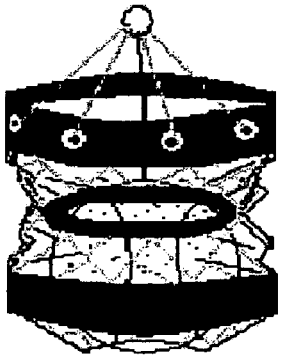
FIG. 4
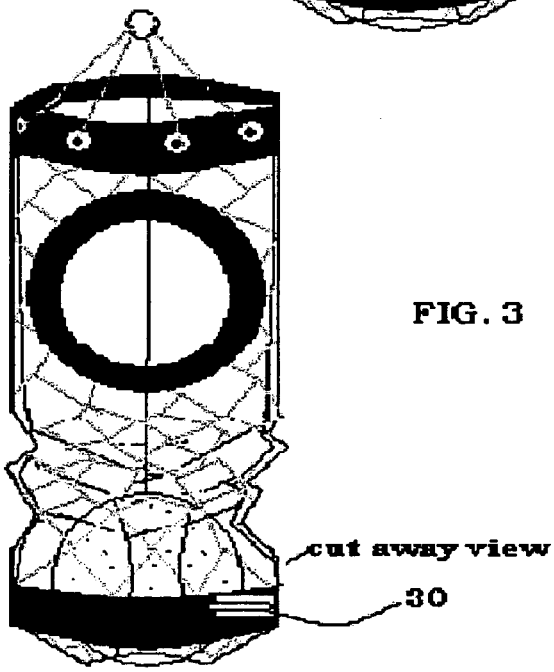
FIG. 3

ADJUSTABLE HANGING SPORTS EQUIPMENT HOLDER AND DISPENSER

FIELD OF THE INVENTION

The present invention relates to devices for holding sports equipment and keeping them organized while utilizing little or unused space. Specifically, the present invention relates to an adjustable/collapsible hanging, yet portable, device for keeping basketballs, soccer balls, footballs, and kickball equipment neatly stored and readily available when needed.

BACKGROUND OF THE INVENTION

Sporting equipment can create an undesirable mess if not kept neatly organized. The task of organizing sports equipment in one's home can be a very challenging one. At home, a closet is often used to store basketballs or footballs. Consequently, the contents of the closet become a hazard as the basketball, football and other contents spill out of the closet when the door is opened. An adjustable elevated device for storing sports balls, whether at home, or in a garage, would serve to prevent tripping or related accidents as well as provide a more organized and efficient manner of storage.

In an effort to address the need for a more efficient storage of sports related balls, particularly, a number of equipment racks have been developed These inventions focus on support devices in which the sports equipment is placed on the rack The device is then dependent on gravity to keep the balls in place; if the ball or device is jarred the ball easily falls off. These inventions do not provide a secure holding device for a ball.

U.S. Pat. No. 5,813,550 discloses a storage rack with treaded pegs. It includes a compact base with two or more pairs of peg holes and two or more pegs that may be inserted into a second pair of holes. While this invention provides a means for storing various items, it does not address the need for storing basketballs, footballs and the like.

Likewise, U.S. Pat. No. 5,335,794 discloses a sports equipment rack. The invention includes both a fixed frame and a removable basket, which provides support for equipment of a variety of sports. The fixed frame includes bat retainers for supporting a plurality of bats and parallel guide members for removable supporting balls such as basketballs, soccer balls, etc. The device is cumbersome and uses too much space unnecessarily.

The foregoing patent and other information reflect the state of the art of which the inventor is aware and are tendered with a view toward discharging the inventor's acknowledged duty of candor in disclosing information that may be pertinent to the patentability of the present invention. It is respectfully stipulated, however, that the foregoing patent and other information do not teach or render obvious, singly or when considered in combination, the inventor's claimed invention.

BRIEF SUMMARY OF THE INVENTION

The general purpose of the present invention, which will be described subsequently in greater detail, is to provide an adjustable apparatus for holding sports related equipment for a home or retail usage while hanging from a ceiling or a wall. An object of the invention is to provide adequate and assessable storage for sports equipment while allowing the user to maintain current floor space. The adjustable holder and dispenser is unique in its utility due to the ability it has to adjust to the user's current space while not taking up premium floor space.

The preferred embodiment of the present invention bas an elongated tubular body and is operable for hanging from a ceiling or wall. The elongated body is formed of a flexible, collapsible material. The front of the present invention has an elastic opening for inserting and retrieving sports equipment. The bottom most end of the present invention is formed of a singular piece of flexible material.

The user expands the front elastic opening when dispensing sports equipment and allows the elastic to contract again when the user wants the present invention to retain the sports equipment currently being held. The present invention can also accommodate holding multiple sports paraphernalia like ball pins and an air pump.

Utilizing one or more flexible elongated members such as a string/cord attached to the bottom most of the tubular material, the cords are disposed within a channel along the tubular material, from the bottom to the top of the present invention to allow the collapsible material to be adjusted in size. The flexible elongated members can be attached to the outside body by various fastening devices to hold the collapsed holder in its adjusted state.

The adjustable holder is portable and lightweight in design, allowing the user to move the apparatus when desired. The adjustable holder can be used inside and outside of the home. The device can easily fit and adjust into a corner of a bedroom, closet, garage, or laundry room.

There has thus been outlined, rather broadly, the more important features of the invention in order that the detailed description of that follows may be better understood, and in order that the present contribution to the art may be better appreciated. There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

Further objects and advantages of the present invention will be apparent from the following detailed description of a presently preferred embodiment which is illustrated schematically in the accompanying drawings.

BRIEF DESCRIPTION OF THE SEVERAL VIEWS OF THE DRAWINGS

Other advantages and features of the invention are described with reference to exemplary embodiments, which are intended to explain and not to limit the invention, and are illustrated in the drawings in which:

FIG. 1 shows a front perspective view of a sports equipment accessory fully extended and holding a single sports ball according to a preferred embodiment of the present invention.

FIG. 2 shows a back perspective view of a sports equipment accessory fully extended and holding a single sports ball according to a preferred embodiment of the present invention.

FIG. 3 shows a front perspective view of a sports equipment accessory in a partially collapsed state and holding a single sports ball according to a preferred embodiment of the present invention.

FIG. 4 shows a front perspective view of a sports equipment accessory in a fully collapsed state and holding a single sports ball according to a preferred embodiment of the present invention.

DETAILED DESCRIPTION OF THE INVENTION

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The present invention provides a new and advantageous device for storing athletic equipment in your home especially the equipment associated with the game of basketball, soccer, football and kickball. The parts list for the present invention includes the following:

Flexible member 2
Hooking device 4
Circular ring 6
Rope 8
Elastic materal 10
Circular opening 12
Mesh 14
Adjustable cord fastener end 16
Sports equipment 18
Top border material 20
Fastener 22
Pocket 24
Elongated Piece of Border material 26
Eyelet opening 28
Circular hoop 30

Referring to FIG. 1, sports equipment 18 is shown within a preferred embodiment of the present invention. One or more of rope 8 is inserted into circular ring 6. Circular ring 6 is preferably made from polyvinyl chloride (PVC), but may be made of metal. Attached to the each end of each rope 8 is at least one hooking device 4. Hooking device 4 is then inserted into eyelet opening 28, which is embedded into top border material 20. Inserted into the uppermost and bottom most region of the border material of the present invention are a plurality of circular hoop 30, made of a smooth plastic such as polyvinyl chloride (PVC) or a metal such as brass, aluminum, or iron. Each circular hoop 30 helps form mesh 14 into a cylindrical or tubular structured shape.

The elongated tube of the present invention is formed from mesh 14. Located in the front of the apparatus, circular opening 12 is located on the front side of the present invention and is formed in mesh 4. Circular opening 12 is used for the insertion and retrieval of sports equipment 18.

The present invention is operable for adjustment in length by utilizing one or more flexible member 2. Flexible member 2 is lined upward along the tubular body of the present invention and inserted through circular hoop 30 and back downward attaching to the tubular body. As the user pulls downward on flexible member 2, attached to the bottommost end of the apparatus, mesh 14 draws upward and reduces the preset invention in size, thus creating a shorter holder of sports equipment.

Referring to FIG. 2, the back side of the present invention is outfitted with a vertical opening utilizing various forms of fastener 22 either the entire length of the present invention of less than the full length of the present invention. The upper back portion of the present invention is outfitted with elongated piece of border material 26 attached onto the upper portion of top border material 20 to accommodate an air-pumping device. This forms a tubular structure for insertion of an air-pumping device.

Attached onto the body of the present invention is pocket 24, preferably made of a formable flexible material, used to house small sporting paraphernalia.

An elongated piece of elastic material 10 is attached to the bottom of mesh 14 to form a bottom circular opening. Elastic material 10 allows the user to obtain said sports equipment when elastic material 10 is expanded, and elastic material 10 also retains sports equipment when it contracts. At least one of adjustable cord fastener end 16 is attached to flexible member 2 by the method of sewing or fabric bonding. The purpose of adjustable cord fastener end 16, which is affixed to the user end of flexible member 2 is to give the user the ability to adjust and hold the present invention to the length desired by the user. Adjustable cord fastener end 16 can be either Velcroed, snapped, hooked, or buttoned to the body of the present invention. When the user pulls downward on the adjustable cords the bottom of the holder goes upward. This is an additional way to secure the desired length of the holder.

Referring to FIG. 3, mesh 14 is shown in a partially collapsed state with sport equipment 18 inside the present invention.

Referring to FIG. 4, the present invention is shown in a fully collapsed state with sport equipment 18 inside.

Although the invention has been described herein with specific reference to a presently preferred and additional embodiments thereof, it will be appreciated by those skilled in the art that various modifications, deletions, and alterations may be made to such preferred embodiment without departing from the spirit and scope of the invention. Accordingly, it is intended that all reasonably foreseeable additions, modifications, deletions and alterations be included within the scope of the invention as defined in the following claims.

The invention claimed is:

1. A sports equipment accessory for storage and retrieval of sports equipment comprising:

a tubular mesh body extending between a top and a bottom;

means for hanging said mesh body;

means for storage of at least one sports ball;

means for dispensing of at least one sports ball including an opening in said tubular mesh body between said top and said bottom, wherein said opening is dimensioned to allow the dispensing of a said sports ball;

means for collapsing said mesh body;

means for accommodating an air-pumping device, and means for holding small sporting paraphernalia.

2. The sports equipment accessory for storage and retrieval of sports equipment according to claim 1, wherein said means for collapsing said mesh body is comprised of flexible members operably connected to a first circular hoop disposed in said top and a second circular hoop disposed in said bottom.

3. The sports equipment accessory for storage and retrieval of sports equipment according to claim 2, wherein said means for hanging said mesh body is comprised of at least one circular ring disposed in said top; at least one rope operably connected to said at least one circular ring and at least one hooking device.

4. The sports equipment accessory for storage and retrieval of sports equipment according to claim 3, wherein said means for dispensing of at least one sports ball is further comprised of an elasticized opening in said bottom.

5. The sports equipment accessory for storage and retrieval of sports equipment according to claim 4, wherein said means for holding small sporting paraphernalia is a pocket affixed to said mesh body.

6. The sports equipment accessory for storage and retrieval of sports equipment according to claim 5, wherein said means for accommodating an air pumping device is a tubular piece of border material.

7. The sports equipment accessory for storage and retrieval of sports equipment according to claim 6, further comprising at least one sports ball.

* * * * *